United States Patent [19]

Lund et al.

[11] 4,440,287

[45] Apr. 3, 1984

[54] FLAKE ALIGNER INCLUDING BAFFLES SUPPORTED ON CONTINUOUSLY MOVING CONVEYOR

[75] Inventors: Anders E. Lund, Houghton; Gordon P. Krueger, Hancock; Lynn B. Sandberg, Chassell, all of Mich.

[73] Assignee: Board of Control of Michigan Technological University, Houghton, Mich.

[21] Appl. No.: 365,623

[22] Filed: Apr. 5, 1982

[51] Int. Cl.[3] ..... B65A 47/24

[52] U.S. Cl. ..... 198/382

[58] Field of Search ..... 198/382, 532, 569; 425/81.1, 82.1, 83.1; 264/108, 24

[56] References Cited

U.S. PATENT DOCUMENTS

| | | | |
|---|---|---|---|
| 842,356 | 1/1907 | Stone | 425/83.1 X |
| 3,068,989 | 12/1962 | Packman et al. | 198/382 |
| 3,807,931 | 4/1974 | Wood et al. | 425/83.1 X |

*Primary Examiner*—Joseph E. Valenza
*Assistant Examiner*—Dennis J. Williamson

[57] ABSTRACT

Apparatus for forming a continuous elongated loosely felted mat of thin elongated wood flakes with the flakes being aligned in mutually parallel interleaved relation. The apparatus includes a plurality of belts positioned in adjacent side-by-side relation and for continuous movement so as to define a supporting surface for the mat. A plurality of sets of thin planar baffle plates are provided, each set including a plurality of thin planar baffle plates supported in coplanar alignment and in edge-to-edge adjacent relation. The baffle plates are positioned between a hopper for depositing wood flakes and the supporting surface and function to align the wood flakes in substantially mutually parallel relation in substantially parallel relation to the direction of movement of the supporting surface and to maintain the wood flakes in substantially parallel alignment as the flakes fall from the hopper onto the supporting surface. Each of the sets of baffle plates are positioned between pairs of belts and are supported for movement with the belts, and the baffle plates of one set are parallel to and spaced closely adjacent to baffle plates of an adjacent set.

9 Claims, 3 Drawing Figures

FLAKE ALIGNER INCLUDING BAFFLES SUPPORTED ON CONTINUOUSLY MOVING CONVEYOR

FIELD OF THE INVENTION

The invention relates to compressed wood particle products and more particularly to apparatus for forming a continuous loosely felted mat of elongated aligned wood flakes, the mat being adapted to be compressed to form a composite wood product.

BACKGROUND PRIOR ART

As set forth in the U.S. Lund et al. Pat. No. 4,241,133, issued Dec. 23, 1980 and assigned to the assignee of the present invention, it has been found to be desirable in the construction of compressed or composite wood particle products to employ wood flakes which are very thin and which have a length at least several times their width and to align the wood flakes in mutually parallel alignment and in alignment with the longitudinal axis of the product being produced. This produces a product having substantially improved strength characteristics in the direction of alignment of the wood flakes. The production of such compressed wood products formed from an assembly of wood particles first requires the formation of a loosely felted mat of wood particles. The mat is then compressed to form a densified panel or board. One problem encountered in forming the loosely felted mat is that the alignment or orientation of the elongated wood flakes is made difficult because the wood flakes, which are very light and comparatively fragile, have to be handled en masse, and this has resulted in the clogging of the known machines that were tried for this purpose.

Examples of prior art attempts to design suitable apparatus for forming mats of aligned wood strands are set forth in the U.S. Elmendorf Pat. No. 3,478,861, issued Nov. 18, 1969; the U.S. Elmendorf Pat. No. 3,220,743, issued Aug. 24, 1965; the U.S. Turner et al. Pat. No. 3,721,329, issued Mar. 30, 1973; the U.S. Urmanov Pat. No. 3,963,400, issued June 15, 1976; and Canadian Pat. No. 597,941, issued May 10, 1960.

Attention is also directed to the U.S. Hostettler Pat. No. 3,226,764, issued June 4, 1966; the U.S. Hostettler Pat. No. 3,070,838 issued Jan. 1, 1963; the U.S. Carlsson et al. Pat. No. 3,692,612, issued Sept. 19, 1972; the U.S. Paerels et al. Pat. No. 3,372,217, issued Mar. 5, 1968; the U.S. Axer et al. Pat. No. 3,824,058, issued July 16, 1974; and the U.S. Chapman Pat. No. 2,992,152, issued July 11, 1961.

Attention is further directed to the U.S. Shockley et al. Pat. No. 3,048,888, and the U.S. Zilver Pat. No. 2,968,386, issued Jan. 17, 1961.

SUMMARY OF THE INVENTION

The invention includes apparatus for forming an elongated continuous mat of elongated wood flakes mixed with a binder and adapted to be compressed to form a densified composite wood product. The apparatus of the invention includes means for depositing elongated wood flakes on a supporting surface and for aligning the wood flakes in mutually parallel relation. The means for continuously feeding and aligning includes a hopper containing wood flakes and for depositing the wood flakes in an evenly distributed relation on a supporting surface, and the supporting surface is comprised of a plurality of parallel adjacent belts supported for continuous movement and defining a grate. Means are also provided for causing alignment of the wood flakes as they are deposited on the supporting surface and for maintaining alignment of the flakes as they drop from the hopper onto the supporting surface.

More particularly, the invention includes apparatus for forming a continuous elongated loosely felted mat of thin elongated wood flakes with the flakes being aligned in mutually parallel interleaved relation. The apparatus includes means defining a mat supporting surface and including a plurality of belts positioned in adjacent side-by-side relation and means for supporting the belts for continuous movement as a conveyor. Means are also provided for depositing wood flakes onto the supporting surface to form a loosely felted mat. The apparatus also includes means positioned between the means for depositing and the supporting surface for aligning the wood flakes in substantially mutually parallel relation and in substantially parallel relation to the direction of movement of the supporting surface and for maintaining the wood flakes in substantially parallel alignment as the flakes fall from the means for depositing onto the supporting surface. The means for aligning and maintaining alignment includes a plurality of sets of thin planar baffle plates, each set including a plurality of baffle plates supported in generally coplanar alignment and in mutually adjacent relation so as to form an elongated continuous baffle and each set being positioned between pairs of the belts. The baffle plates of one set are supported parallel to and spaced closely to baffle plates of an adjacent set of baffle plates. Means are also provided for supporting the baffle plates for movement with the belts.

Various other features and advantages of the invention will be apparent from the following description of a preferred embodiment, from the claims, and from the drawings.

Figure 1:
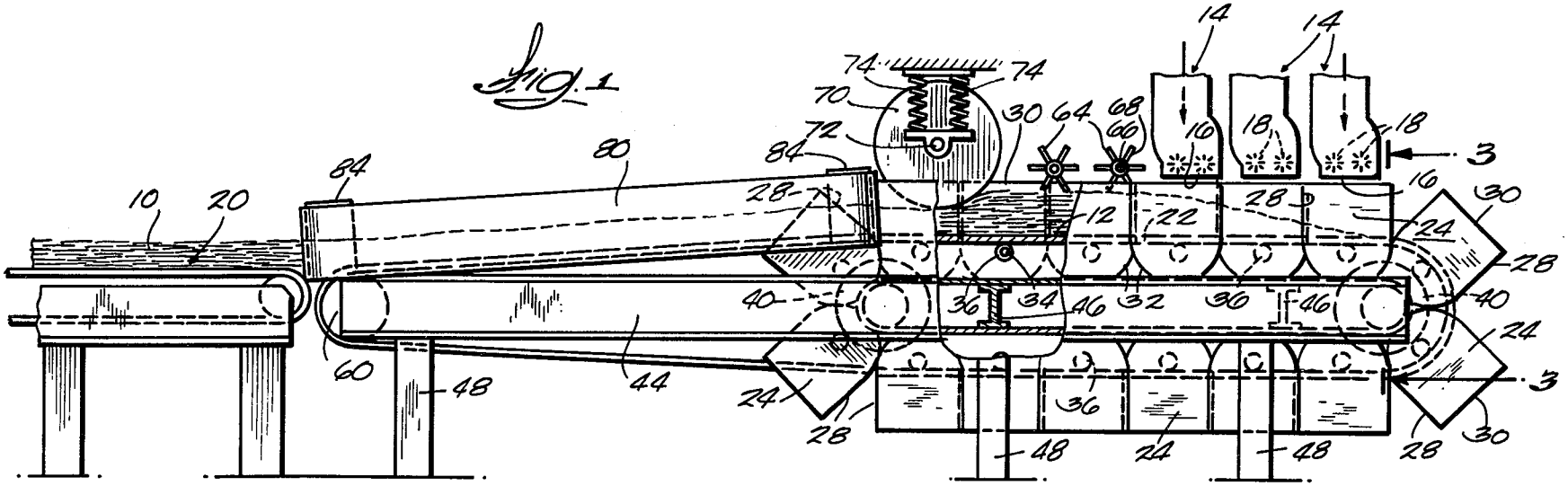
FIG. 1 is a side elevation view of apparatus embodying the present invention and for forming a loosely felted mat of aligned wood flakes.

Before describing a preferred embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an apparatus for forming an elongated continuous loosely felted mat 10 comprised of elongated wood flakes and a binder, this mat 10 being adapted to be placed in a press (not shown) and to be compressed therein to form a densified composite wood product such as is illustrated, for purposes of example, in the U.S. Lund et al. Pat. No. 4,241,133.

The apparatus illustrated in FIG. 1 includes a means for depositing a furnish comprised of a mixture of elongated wood flakes and a binder onto a supporting surface 12 to thereby form a loosely felted mat of flakes on the supporting surface. While the furnish may be comprised of wood fibers, strands, particles or chips for use in making particleboard, fiberboard or flakeboard, in a preferred embodiment, the furnish is comprised of a mixture of wood flakes and a binder material as set forth in the U.S. Lund et al. patent referred to above. In such an application it is preferred that the wood flakes be oriented in the loosely felted mat in mutually parallel relation and in parallel relation to the longitudinal axis of the product to be formed, to thereby produce a compressed wood product having improved strength characteristics. Additionally, it is preferred that the wood flakes of the furnish should have an average length of about 0.5 inch to about 3.5 inches, preferably about 1 inch to about 2 inches, and an average thickness of about 0.01 to about 0.05 inch. Flakes thinner than about 0.01 inch tend to require excessive amounts of binder to be mixed with these flakes if an adequate bonding of the flakes is to occur in the compressed product. Flakes thicker than about 0.05 inch are relatively stiff and tend to require excessive compression in order to obtain the desired intimate contact therebetween. In any given batch, some of the flakes can be shorter than 0.5 inch and some can be longer than 3.5 inches so long as the overall length of the flakes is within the above range. The same is true for the thickness. To facilitate proper alignment of the flakes, it is preferred that the flakes should have a length which is several times the width. Using this constraint as a guide, the average width of the flakes should be about 0.1 to 0.5 inches.

The furnish is formed by introducing flakes of the size described above into a conventional blender wherein predetermined amounts of a binder are applied to the flakes as they are tumbled or agitated in the blender. Suitable binders include those used in the manufacture of particleboard and similar pressed particle products. Such binders may include organic polyisocyanates including those curable at room temperature or urea formaldehyde.

Referring again to the means for depositing the furnish onto the supporting surface 12, while various depositing means could be employed, in the illustrated arrangement that apparatus includes a plurality of hoppers 14 positioned in adjacent relation above the supporting surface and spaced along the length of the supporting surface 12. Each of the hoppers 14 supports a quantity of furnish and includes an opening 16 for depositing the furnish on the supporting surface. In the illustrated construction each hopper includes a pair of picker rolls 18 positioned closely adjacent to the opening 16 for controlling the quantity of furnish falling onto the supporting surface 12 in an evenly dispursed pattern. Since there are three hoppers 14 positioned in series along the supporting surface, as the supporting surface moves continuously under the hoppers, the mat thickness will build up to the desired level.

The supporting surface 12 is constructed so as to be adapted to be continuously moving and to receive wood flakes deposited by the hoppers 14 and for continuously carrying the loosely felted mat 10 to a second conveyor 20 or to a press apparatus where the loosely felted mat 10 can be compressed to form a densified composite wood product. While the means for forming the supporting surface 12 can have various constructions, in the illustrated arrangement, the means for forming the supporting surface includes a plurality of narrow conveyor belts 22 positioned in closely adjacent relation, the conveyor belts 22 being positioned sufficiently close together so as to define a generally uniform supporting surface 12 for receiving flakes from the hoppers.

Means are also provided for causing mutual alignment of the flakes as they are deposited on the supporting surface 12 and for maintaining alignment of the flakes as they fall onto the supporting surface and on the mat being built up on the supporting surface. In the illustrated construction, such means includes a plurality of thin planar baffle plates 24 positioned between the conveyor belts 22. More particularly, the aligning means are comprised of a plurality of sets of baffles or baffle plates 24, each set being comprised of a plurality of baffles lying in generally coplanar relation and positioned in mutually abutting relation and lying in a gap between two of the conveyor belts 22 to form an elongated continuous baffle. The baffles 24 in each set are thus arranged so as to define a continuous loop including an upper flight and a lower flight. The illustrated construction also includes a plurality of sets of baffles, with one set being positioned in each elongated narrow gap between the respective conveyor belts 22 and such that the baffles of respective sets are positioned in parallel closely adjacent relation. As an example of a preferred spacing between the sets of baffles, when the furnish is comprised of flakes having the geometry referred to above, a suitable spacing between baffles 24 may be $\frac{5}{8}$ inch, center-to-center of the baffles.

Figure 2:
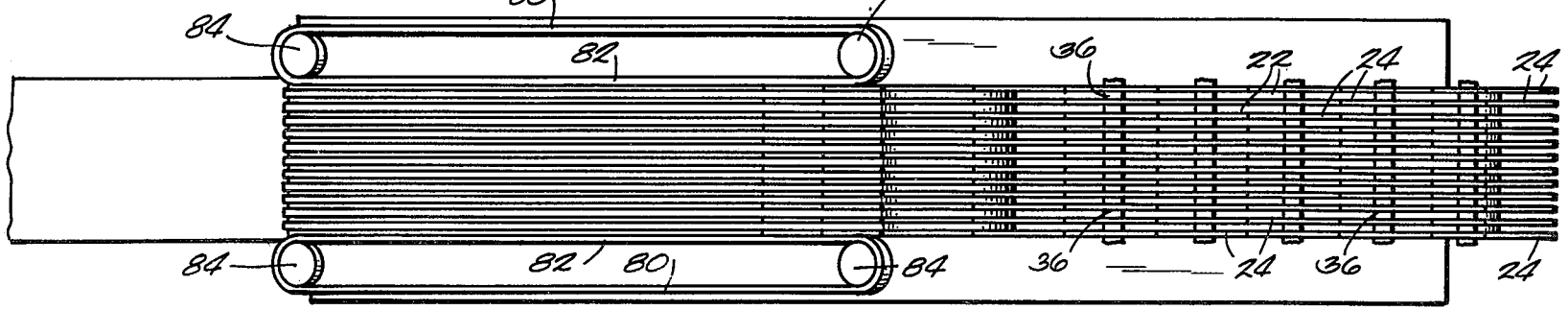
FIG. 2 is a plan view of a portion of the apparatus shown in FIG. 1.
Figure 3:
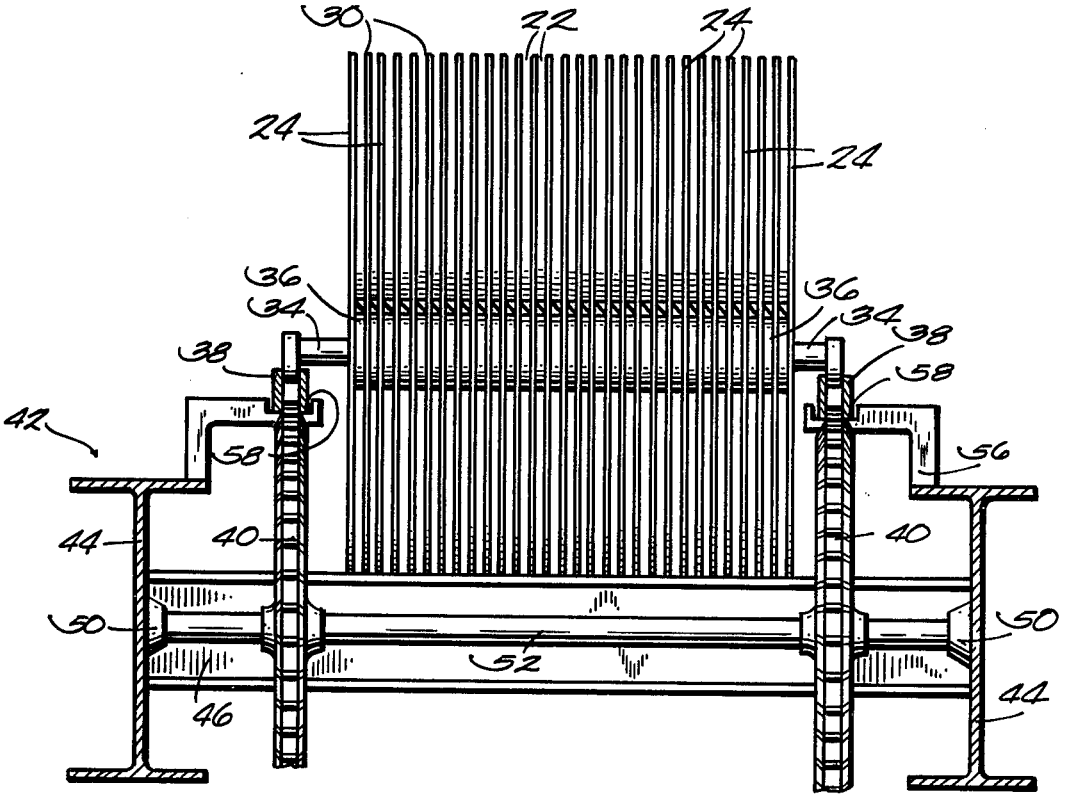
FIG. 3 is a cross section view taken along line 3—3 in FIG. 1.

While the baffles 24 may be constructed of various materials and have other shapes, in the particular arrangement illustrated the baffles 24 are comprised of sheet metal. The thickness of the baffles as shown in FIGS. 2 and 3 is exaggerated for ease of illustration. The baffles 24 are shown as each being generally rectangular including linear sides or edges 28 and a linear upper edge 30, but having a lower edge 32 which is rounded so as to have a semicircular shape. The baffles 24 of each set are adapted to be arranged with their lateral edges 28 in parallel abutting or closely adjacent edge-to-edge relation and with the upper edges 30 of adjacent baffles forming the upper and lower flights being colinear. In other arrangements the baffle plates could be circular and with the edges of adjacent baffle plates overlapping.

Means are also provided for supporting the baffle plates 24 and for causing movement of the baffle plates with the belts 22. In the illustrated arrangement, the means for supporting the baffles 24 includes a plurality of baffle support shafts 34, the baffle support shafts 34 being horizontal and extending perpendicularly to the direction of movement of the supporting surface 12. The support shafts 34 each extend through the centers of a plurality of baffles 24 positioned in parallel spaced apart relation, and the baffles 24 are held in spaced apart relation on the baffle shafts 34 by spacer rings 36 surrounding the baffle shafts 34 and with one spacer ring 36 positioned between each pair of baffles 24. The opposite ends of the baffle shafts 34 are connected to chains 38, and the chains 38 are each supported at their opposite ends by drive wheels 40. While various means could be provided for rotatably supporting the drive wheels 40, in the illustrated construction, the apparatus includes a frame 42 comprised of a pair of spaced apart horizontal beams 44 parallel to the direction of movement of the supporting surface 12. The beams 44 are held in spaced relation by transverse beams 46, and the frame 42 is supported by legs 48. The beams 44 support bearings 50 which in turn rotatably support opposite ends of drive shafts 52 supporting the drive wheels 40.

Means are further provided for supporting the upper horizontal flights of the chains 38, this means including a pair of tracks 56 having upwardly opening channels 58 for slideably supporting the chains 38. The tracks 56 are welded to the upper portions of the main beams 44 of the frame 42 so as to be fixedly supported. The channels 58 of the tracks 56 support the chains 38 and consequently the baffle shafts 34, such that those baffle shafts, supported by the upper flights of the chains 38, are held in substantially coplanar alignment and are not permitted to sag intermediate the drive wheels 40.

The baffles 24 are supported on the baffle shafts 34 such that the upper edges 30 of the baffles 24 supported by the upper flights of the chains 38 are positioned closely adjacent the openings 16 of the hoppers 14 as the baffles 24 move beneath the hoppers. By providing the baffles with a rounded or semicircular lower edge 32 and by supporting the baffles 24 on the baffle shafts 34 such that the axes of the shafts extend through the center or axes of the semicircular portion, the baffles 24 can move around the axes of the drive shafts 34 without interference of adjacent baffle plates. To facilitate such movement of the baffle plates, it is important that the baffles 24 are supported on the baffle shafts 34 with the axis of the shafts 34 being intermediate the opposite edges 28 of the baffle plates and spaced from the bottom edges 32 of the baffle plates by a distance equal to one-half the width of the baffle plates, i.e. the radius of curvature of the rounded lower edge 32 of the baffle plates.

Means (not shown) are also provided for driving at least one of the drive shafts 52 and for thereby driving the drive wheels 40 and the chains 38. While various means could be provided, in one arrangement an electric motor could be drivingly connected by means of reduction gears to the drive shaft 52.

It should be noted that in the illustrated construction, the narrow conveyor belts 22 have a width approximating that of the spacing between the baffles 24, and the upper flights of the belts 22 are supported by the baffle spacers 36, in turn supported by the baffle shafts 34. The conveyor belts 22 are also supported by a roller 60 rotatably supported by the ends of the frame beams 44.

While in the illustrated construction a plurality of conveyor belts 22 are positioned between the baffles 24 and form the supporting surface 12, in other arrangements other suitable flexible means could be employed in place of the conveyor belts and to form a suitable supporting grate. Accordingly, as used herein and in the claims hereinafter, the term conveyor belt should be read as including any elongated flexible endless member suitable to support the mat.

In operation of the belts 22 and the baffles 24 described, as the chains 38 cause continuous movement of the baffles 24 and the belts 22 under the hoppers 14 the flakes deposited by the hoppers 14 will fall between the baffles so as to become aligned in substantially parallel relation to the planes of the baffles. As the flakes fall between the baffles, they will assume a horizontal orientation and they will maintain their mutually parallel alignment and be aligned with the direction of movement of the supporting surface 12. As the baffles 24 and the belts 22 continue to move away from the hoppers 14, the baffles will then be pulled downwardly around the drive wheel 40 shown at left in FIG. 1 through the wood flakes leaving the mat supported by the conveyor belts.

During the depositing of the wood flakes by the hoppers 14, the flakes are deposited in a random orientation and some of the flakes will not fall between the baffles 24 and will lie across the upper edges of the baffles. Means are also provided for causing any flakes falling from the hoppers 14 across the baffles to be aligned with the baffles and to fall therebetween. In the illustrated construction, that means includes a pair of picker rolls 64 positioned adjacent the hoppers 14 but positioned in spaced relation from the hoppers in the direction of movement of the supporting surface 12. The picker rolls 64 each include a rotatably driven central shaft 66 extending perpendicularly to the direction of movement of the baffles and adjacent their upper edges 30. A plurality of fingers or rods 68 are joined to the shafts 66 along their lengths and extend radially outwardly from the shafts. The picker rolls 64 are rotatably driven in the counterclockwise direction as seen in FIG. 1 and such that the radially extending fingers 68 will sweep downwardly between the baffles 24 to engage any flakes lying across the baffles. The fingers 68 will push these flakes into alignment with the baffles 24 whereupon the flakes will fall between the baffles.

Means are further provided for pressing the loosely felted mat 10 against the supporting surface 12 to precompress the mat material. While the means for pressing the mat material may have various constructions, it includes a plurality of discs 70 supported for rotation by a horizontal shaft 72. The discs 70 are supported so as to include portions extending down between the baffles 24 to engage the mat. The discs 70 each have a width approximating that between the baffles 24 and are spaced apart by distances approximating the thickness of the baffles. Means are also provided for biasing the discs 70 downwardly against the surface of the mat 10, the biasing means being shown in the illustrated construction as comprising compression springs 74 supporting the shaft 72.

Means are also provided for supporting the edges of the mat 10 as the mat moves past the baffles 24 and is carried by the conveyor belt 22 to the conveyor 20 or to a press. In the illustrated arrangement, this means includes a pair of conveyor belts 80 positioned on opposite sides of the mat 10, the belts 80 each including an inner belt flight portion 82 having a substantially vertical surface engageable against the edge of the mat 10. The belts 80 are supported at their opposite ends by rollers 84.

Various features of the invention are set forth in the following claims.

We claim:

1. Apparatus for forming a continuous elongated loosely felted mat of thin elongated wood flakes with the flakes being aligned in mutually parallel interleaved relation, the apparatus comprising means defining a mat supporting surface and including a plurality of conveyor belts positioned in adjacent side-by-side relation and means for supporting the conveyor belts for continuous movement as a conveyor, means for depositing wood flakes onto the supporting surface to form a loosely felted mat, means positioned between the means for depositing and the supporting surface for aligning the wood flakes in substantially mutually parallel relation and in substantially parallel relation to the direction of movement of the supporting surface and for maintaining the wood flakes in substantially parallel alignment as the flakes fall from the means for depositing onto the supporting surface, said means for aligning and maintaining alignment including a plurality of sets of thin planar baffle plates, each of said sets including a plurality of thin planar baffle plates supported in generally coplanar alignment and in mutually adjacent relation to form an elongated continuous baffle and each of said sets being positioned between pairs of said conveying members, said baffle plates of one set being separated from said baffle plates of an adjacent set by one of said conveyor belts and parallel to the baffle plates of an adjacent set of baffle plates, and means for supporting said baffle plates for movement with said supporting surface.

2. Apparatus as set forth in claim 1 wherein said baffle plates lie in vertical planes and wherein at least a plurality of said baffle plates each include a first portion adapted to extend upwardly from between said conveyor belts.

3. Apparatus as set forth in claim 2 wherein said first portion includes an upper edge adjacent said means for depositing and vertical sides positioned in adjacent side-by-side relation with linear sides of adjacent baffle plates.

4. Apparatus as set forth in claim 2 wherein each of said plurality of plates include a lower portion extending below said supporting surface, said lower portion having a curved edge forming a semicircle.

5. Apparatus as set forth in claim 1 wherein said means for aligning and maintaining alignment includes a plurality of baffle support shafts, conveyor means for supporting said shafts for continuous movement, said shafts being supported in horizontal relation and with their longitudinal axes in mutually parallel relation and being perpendicular to the direction of movement of said mat supporting surface, a first group of baffles supported in spaced stacked relation on a first one of said shafts, said baffles of said first group defining planes perpendicular to the axis of said first shaft, and a second group of baffles supported in spaced stacked relation on a second shaft, said baffles of said second group defining planes perpendicular to the axis of said first shaft, and said baffles of said first group including edges closely adjacent edges of said baffles of said second group.

6. Apparatus as set forth in claim 5 wherein said conveyor means supports said shafts and said baffles for horizontal movement beneath said means for depositing.

7. Apparatus as set forth in claim 1 wherein said means for depositing wood flakes on said supporting surface includes a plurality of hoppers positioned in spaced relation along the length of a portion of said supporting surface, said hoppers each including means for depositing flakes onto said supporting surface and said hoppers depositing flakes on said supporting surface successively as said supporting surface moves beneath said hoppers.

8. Apparatus as set forth in claim 1 and further including means for pressing said mat against said supporting surface, said means for pressing including a plurality of planar circular discs and means for supporting said discs above said supporting surface with said discs extending between said baffles and with said discs engageable against said mat for forcing it against said supporting surface.

9. Apparatus as set forth in claim 1 wherein said means for aligning said wood flakes includes means for causing wood flakes from said hopper to fall between said sets of baffles and including a rotatable shaft positioned above said baffles, a plurality of fingers disposed along the length of said shaft and extending radially outwardly from said shaft, said fingers being positioned so as to extend downwardly between said sets of baffles when said shaft rotates and to contact flakes lying across said sets of baffles, and means for causing rotation of said shaft.

* * * * *

UNITED STATES PATENT AND TRADEMARK OFFICE

CERTIFICATE OF CORRECTION

PATENT NO. : 4,440,287

DATED : April 3, 1984

INVENTOR(S) : Anders E. Lund, Gordon P. Krueger, Lynn B. Sandberg

It is certified that error appears in the above-identified patent and that said Letters Patent is hereby corrected as shown below:

On the title page:

Inventors should read:

Anders E. Lund, Houghton; Gordon P. Krueger, Hancock; Lynn B. Sandberg, Chassell; Roy D. Adams, Houghton, all of Mich.

Signed and Sealed this

*Twenty-eighth* Day of *May 1985*

[SEAL]

*Attest:*

DONALD J. QUIGG

*Attesting Officer* *Acting Commissioner of Patents and Trademarks*